United States Patent [19]

Cody et al.

[11] Patent Number: 5,077,470

[45] Date of Patent: Dec. 31, 1991

[54] MASS SPECTROMETER

[75] Inventors: Robert B. Cody, Newton, N.H.; Andrew N. Tyler, Reading, Mass.

[73] Assignee: JEOL Ltd., Tokyo, Japan

[21] Appl. No.: 639,976

[22] Filed: Jan. 11, 1991

[51] Int. Cl.[5] ..... H01J 49/04

[52] U.S. Cl. ..... 250/282; 250/288

[58] Field of Search ..... 250/282, 288, 288 A

[56] References Cited

U.S. PATENT DOCUMENTS 4,874,944 10/1989 Kato ..... 250/288

4,908,512 3/1990 Caprioli et al. ..... 250/288

OTHER PUBLICATIONS

"Design and Performance of a Continuous Flow Probe HPLC Interface for a Liquid SMS Time of Flight Mass Spectrometer", Chen et al. presented at the 36th ASMS Conference on Mass Spectrometry and Allied Topics (San Francisco, Calif., Jun. 1988), pp. 809-810.

"Liquid Seconary Ion Time-of-Flight Mass Spectrometry", Analytical Chemistry, vol. 59, No. 7 (Apr. 1987), Olthoff et al., pp. 999-1002.

"Liquid Scondary Ion Mass Spectrometry I. Molecular Ion Intensities as a Function of Primary Ion Pulse Frequency", Olthoff, J. K.; Cotter, R. J., *Instruments and Methods in Physics Research* B26 (1987), pp. 566-570.

"Evaluation of Pulsed Fast-Atom Bombardment Ionization for Increased Sensitivity of Tandem Mass Spectrometry", Russell et al., Anal. Chem. 61, pp. 153-159.

*Primary Examiner*—Jack I. Berman

*Attorney, Agent, or Firm*—Webb, Burden, Ziesnheim & Webb

[57] ABSTRACT

A method of mass spectrometry comprises the steps of ionizing the mixture of the sample and the matrix by repeated irradiation with primary particle beam pulses; introducing the produced ions into a mass analyzer and separating the ions with the mass analyzer according to their mass/charge ratios; detecting signals indicative of the number of the separated ions with an array detector; and integrating the detected signals during data collection periods in synchrony with the irradiation pulses of the primary particle beam. The data collection periods have a predetermined duration and predetermined start times relative to the primary particle beam pulses.

24 Claims, 4 Drawing Sheets t2
t1
ON
FAB
OFF td

RESET
TRIGGER

READOUT
TRIGGER

MAGNET
POWER
SUPPLY
TRIGGER

MAGNET
EXCITING
CIRCUIT

MASS SPECTROMETER

BACKGROUND OF THE INVENTION

Involatile materials and materials with low volatility are difficult to analyze by mass spectrometry because it is necessary to vaporize the materials prior to ionization. Materials that are thermally stable may be heated to increase their volatility. Unfortunately, molecules of biological origin, such as peptides, decompose when heated. One technique for producing molecular ions from such molecules comprises irradiating a solution or dispersion of the analyte molecules with a primary particle beam composed of ions (secondary-ion mass spectrometry or SIMS) or atoms (fast atom bombardment or FAB).

The SIMS and FAB techniques produce ions not only of the analyte but also of the matrix (the solvent or liquid carrier) in which the analyte is dissolved or dispersed. This produces a background spectrum that effectively limits the sensitivity of the experiment. For example, the detection limit for the peptide Eledoisin (molecular weight equals 1187 daltons) when dispersed in a glycerol matrix and analyzed by normal FAB techniques is in the range of one to ten picomoles (1 picomole $=10^{-12}$ mole). At lower quantities this molecular species $[M+H]+$ cannot be distinguished from the background spectrum evolved from the matrix in which the analyte is dispersed or dissolved.

It has been known for some time by the applicants and others that the rates at which analyte ions and matrix ions are formed immediately following initiation of primary particle beam bombardment are often different. This phenomenon is documented, for example, in Musselman et al. "Differential Appearance of Analyte and Matrix During the First Seconds of Sputtering by Fast Atom Bombardment," a paper presented at the 35th ASMS Conference on Mass Spectrometry and Allied Topics (Denver, Co., May, 1987). This phenomenon, while known, has never been suggested as the basis of an improved mass spectrometry analyte ion generation technique.

Several FAB mass spectrometry techniques make use of ion pulses but only for special cases such as time-of-flight (TOF) spectrometers and Fourier transform mass spectrometry. See, for example, Shabanowitz et al. "Tandem Quadrupole-Fourier Transform Mass Spectrometry: New Developments," presented at the 34th Annual Conference on Mass Spectrometry and Allied Topics, (Cincinnati, Ohio, June, 1986); Olthoff et al. "Desorption Mechanisms Using A New Liquid-SIMS-TOF Mass Spectrometer," a paper presented at the 35th ASMS Conference on Mass Spectrometry and Allied Topics (Denver, Co., May, 1987); Chen et al. "Design and Performance of a Continuous Flow Probe HPLC Interface for a Liquid SIMS Time-of-Flight Mass Spectrometer," a paper presented at the 36th ASMS Conference on Mass Spectrometry and Allied Topics (San Francisco, Calif., June, 1988); Olthoff et al. "Liquid Secondary Ion Time-of-Flight Mass Spectrometry," *Analytical Chemistry*, Vol. 59, No. 7 (April, 1987).

The applicants are aware of no pulsed technique for dramatically increasing the sensitivity of the FAB or SIMS experiments using a conventional double-focussing mass spectrometer.

SUMMARY OF THE INVENTION

It is an advantage according to this invention to provide a mass spectrometry method and apparatus suitable for simple double-focussing mass spectrometers that can improve the sensitivity from the picomole range to the femtomole range (1 femtomole $=10^{-15}$ mole) or the attomole range (1 attomole $=10^{-18}$ mole) for molecules of biological origin and the like.

Briefly, according to this invention, there is provided a mass spectrometry method for analyzing a sample mixed with a matrix comprising the following steps: The mixture of the sample and the matrix is ionized by repeated pulses of a primary particle beam irradiation. The ions so produced are introduced into a mass analyzer and separated according to their mass/charge ratios. Then, the separated ions are detected by an array detector to produce signals indicative of the number of ions reaching the sensors. Finally, the signals are detected and integrated during a data collection period in synchrony with the irradiation pulses of the primary particle beam. The data collection period is established to have a predefined duration and a predefined start time relative to the primary particle beam pulse.

According to one embodiment, the reset and readout times of the array detector are adjusted until the ratio of a signal indicative of a sample ion to the background signal is maximized for a given set of mass spectrometer conditions. After the signal ratio is maximized and the array detector is read, and the intensity of the magnetic field of the mass spectrometer is jumped stepwise, the reading and magnet jumping steps are repeated until the desired mass range is detected.

According to another preferred embodiment, a plurality of readings are taken at each intensity level of the magnetic field while the reset time is varied over a range and the data gathered over the plurality of readings is processed, as by differentiation, to enable analyte peaks to be easily distinguished from matrix peaks.

Further, according to this invention, there is provided an improvement in a mass spectrometry system for analyzing a sample mixed with matrix, comprising a sample support for the sample mixed with matrix, a particle beam generator, a mass analyzer and a detector. As is known in the art, these elements are maintained in an evacuated enclosure. The improvement comprises the following: A pulsed particle beam generator directs primary particle pulses at the mixture of the sample and the matrix to produce analyte and analyte fragment ions. Accelerating electrodes direct the sample ions into the mass analyzer for separating the ions according to their mass/charge ratios. At the output of the mass analyzer, an integrating array detector is provided for generating signals indicative of the number of separated ions incident thereto. The detector can be reset by a reset signal and read by a readout signal applied thereto. Timing circuits are provided for controlling the frequency of the particle beam pulses, the time relative to the start of the particle beam of the reset signal and the time following the reset signal to the readout signal. Preferably, a computer logs the detected signals in synchrony with the irradiation of the primary particle beam pulse and integrates the logged signals.

According to the inventions disclosed herein, the primary particle beam may comprise ionized species or neutral species. Preferably, the mass analyzer comprises any combination of electric and/or magnetic fields for dispersing and separating the ions according to mass.

More preferably, the mass analyzer comprises a double-focusing magnetic sector mass spectrometer.

BRIEF DESCRIPTION OF THE DRAWINGS

Further features and other objects and advantages will become clear from the following detailed description made with reference to the drawings in which.

DESCRIPTION OF THE PREFERRED EMBODIMENTS

Figure 1:
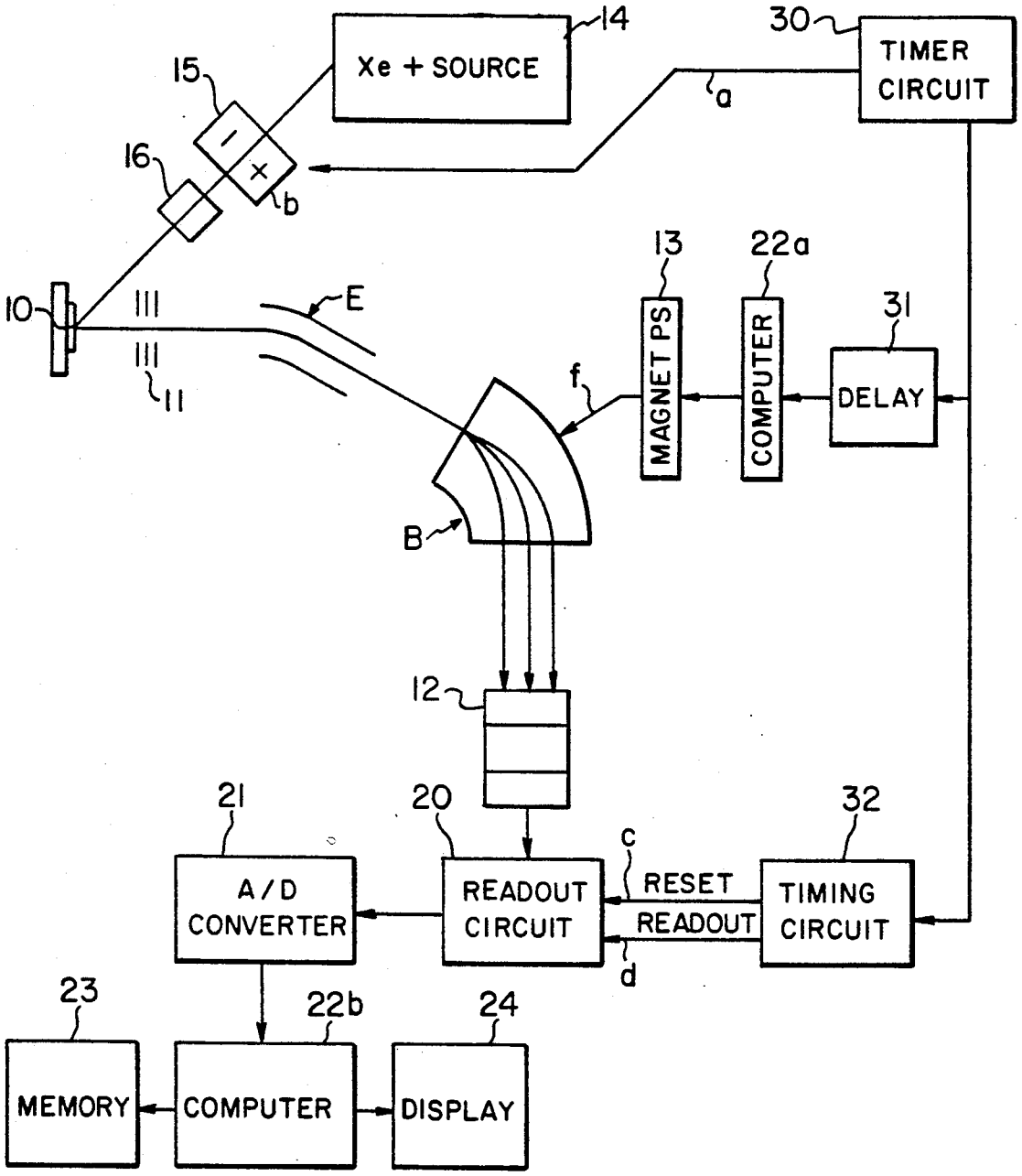
FIG. 1 is a schematic of a hardware system for the practice of a preferred embodiment of this invention.

Referring now to FIG. 1, there is shown schematically a two-sector, double-focussing mass spectrometer comprising an electric field E and a magnetic field B. Ions desorbed from the matrix lo with the dissolved or dispersed sample therein are accelerated by electrodes 11 through the electric and magnetic fields where the ions are dispersed according to mass/charge ratio. The dispersed ions are directed to an integrating array detector 12. The magnetic field power supply 13 is adjustable in response to a signal from a computer 22*a* arranged to control the stepwise scanning of the magnetic field.

The particular instrument used in the experiments described hereafter was a JEOL JMS-HX110 mass spectrometer with a three-inch array detector. Any number of mass spectrometers might be suitable for the practice of this invention.

In the case of fast atom bombardment (FAB), the matrix and sample are bombarded with a neutral atom beam which may be generated as follows: Positive Xenon ions from an ion source 14 are accelerated through deflector plates 15 and through a neutralization chamber 16 from which they are directed to the matrix and sample. The deflector plates are used to deflect the ions from the path leading to the sample when an electric field is produced therebetween. It is recognized that any other method for producing pulsed primary particle beams may be suitable for the practice of this invention. It is also recognized that pulsed irradiation may be achieved by mechanical positioning of the sample support.

The details of a suitable array detector are described in an article entitled "Development of an Array Detector for Wide Mass Range Detection" by Musselman et al. presented at the 37th ASMS Conference on Mass Spectrometry and Allied Topics (Miami Beach, Fla., May, 1989). The array detector comprises a plurality of microchannel detectors 12.5 microns in diameter. A photoplate or a Position-and-Time-Resolved Ion Counting (PATRIC) detector may be used in place of the preferred array detector.

The full benefits of pulsed sample radiation according to this invention cannot be realized using point detectors, e.g., multiple ion monitoring or rapid scanning experiments, because of the limited duration of the enhanced analyte signal. Practically speaking, the scanning speed of most mass analyzers is too slow to scan across multiple peaks during the time the analyte ions are desorbed following the start of a primary beam pulse. Moreover, a rapid scan does not allow signal integration and therefore does not allow an improvement in the signal-to-noise ratio. Due to the short period of time when analyte ions are desorbed following the start of the primary beam pulse and the length of the recovery period required between pulses, an array detector (a detector that records a plurality of ions with different mass/charge ratios simultaneously) is essential for detecting peak shapes, isotope species and background species. Observation of peak shapes enables detection of overlapping peaks and more accurate mass detection by determination of peak centroids. Observation of peak shapes also helps to determine if the mass spectrometer is correctly tuned.

The array detector 12 is connected to a readout circuit 20. The readout circuit controls the reset and readout of each individual microchannel detector (sensor). Upon readout, the microchannel detectors are connected one after the other to an analog-to-digital converter 21 and the digitized signals are sent to a data logging computer 22*b* having a memory 23 and a display 24. Of course, computers 22*a* and 22*b* may comprise the same computer.

The operation of the system is controlled by a timer circuit 30 that generates timing signals applied to the deflector plates 15, a delay circuit 31 connected to the magnetic field power supply computer 22*a* and a timing circuit 32 that generates reset and readout signals for application to the readout circuit 20. The timer circuit 30, delay circuit 31 and timing circuit 32 can be implemented with one programmed digital computer controlling 4 bits of an output port.

Figures 2A, 2B, 2C, 2D, 2E, 2F:
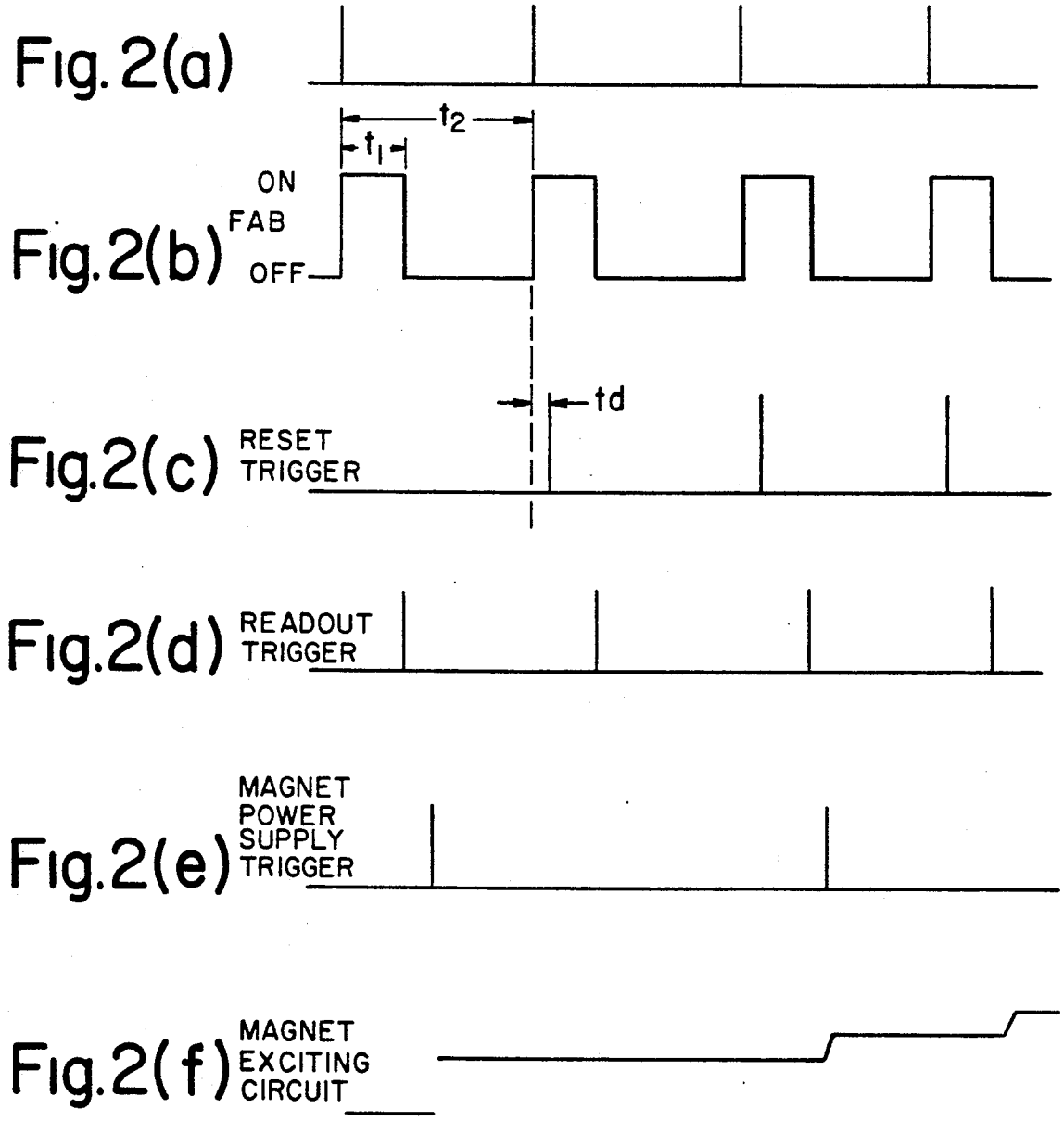
FIGS. 2(*a*) to 2(*f*) are timing diagrams illustrating the operation of the system shown in FIG. 1.

Referring to FIG. 2(*a*), a master timing signal determines the period $t_2$ between the start of each primary particle beam pulse to be applied to the matrix and sample. The length of the period $t_2$ is between 0.25 seconds and 20 seconds with a typical value being 10 seconds. All other signals are based upon this master timing signal. The duration of the primary particle beam pulse is controlled by the duration of the deflection pulse (see FIG. 2(*b*)) applied to the deflector plates 15. The deflection pulse is initiated by the master timing pulse. The adjustable length $t_1$ of the deflection pulse (see FIG. 2(*b*)) is controlled by the timer circuit 30. The duration of the pulse is adjusted to be optimum. This is the duration which produces the highest ratio of analyte ions to matrix ions.

Referring to FIG. 2(*c*), the reset trigger signal applied to the detector is applied somewhat before or after the master timing signal so that reset is completed before, say, 75 milliseconds after the start of the primary particle pulse when peak analyte ion evolution typically takes place. A delay time td of up to 50 milliseconds after the start of the particle pulse is typical. Referring to FIG. 2(*d*), a readout pulse initiates reading of the detector somewhat prior to or somewhat following the end of the primary beam pulse. Readout should begin soon after the analyte ions are no longer produced in a high ratio to the matrix ions. A typical half-life of the analyte ion output is about 150 milliseconds following the initiation of sample irradiation.

It is important to realize that the array detector is storing and integrating data for some period of time between the reset and readout pulses. At the end of this period, the stored data is written to a computer mass storage memory, for example, a disk for subsequent processing. The time window for data collection and storage can be varied from run to run until best results are obtained.

Shortly after the readout pulse, a magnet power supply stepping pulse (see FIG. 2(*e*)) is generated to initiate the stepwise scan of the magnetic field B (FIG. 2(*f*)). Of course, the stepping pulse could be generated upon some multiple of master pulses or the magnetic field control could be arranged to count a plurality of stepping pulses before causing the magnetic field to step. In this way, data gathered over multiple particle pulses can be integrated to improve the signal-to-noise ratio. Accordingly, the magnetic field is jumped across the detection mass range. Typical values for $t_1$, $t_2$, and td are 500 milliseconds, 10 seconds and 50 milliseconds, respectively.

Figure 3:
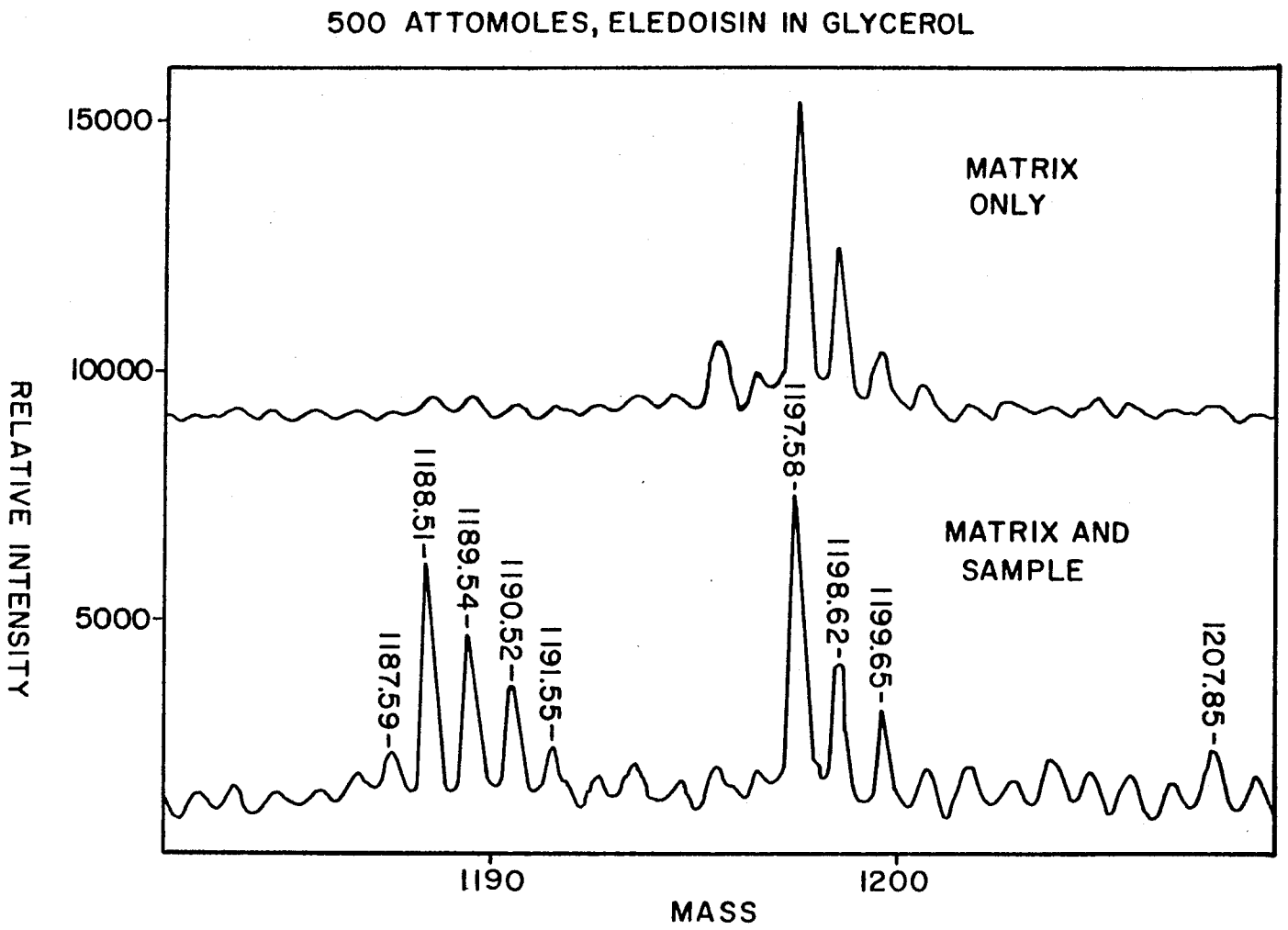
FIGS. 3, 4, and 5 show related groups of mass spectra according to the teachings of this invention.

Referring to FIG. 3, the method according to this invention has been practiced and shown to be capable of detecting peptides in attomole quantities whereas with continuous FAB techniques it would only be expected to detect peptides in picomole quantities. The figure shows two spectra, one of the matrix only and the other showing the ion isotope cluster for the peptide Eledoisin present in a quantity of five hundred attomoles.

Figure 4:
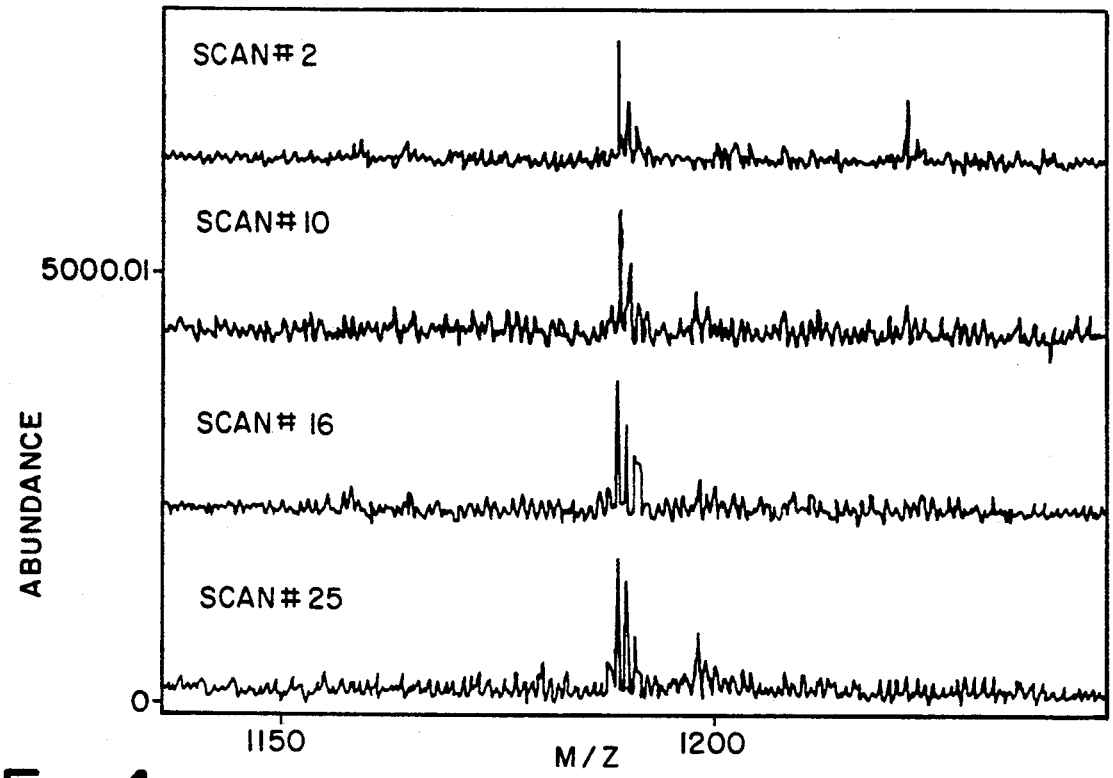
Figure 5:
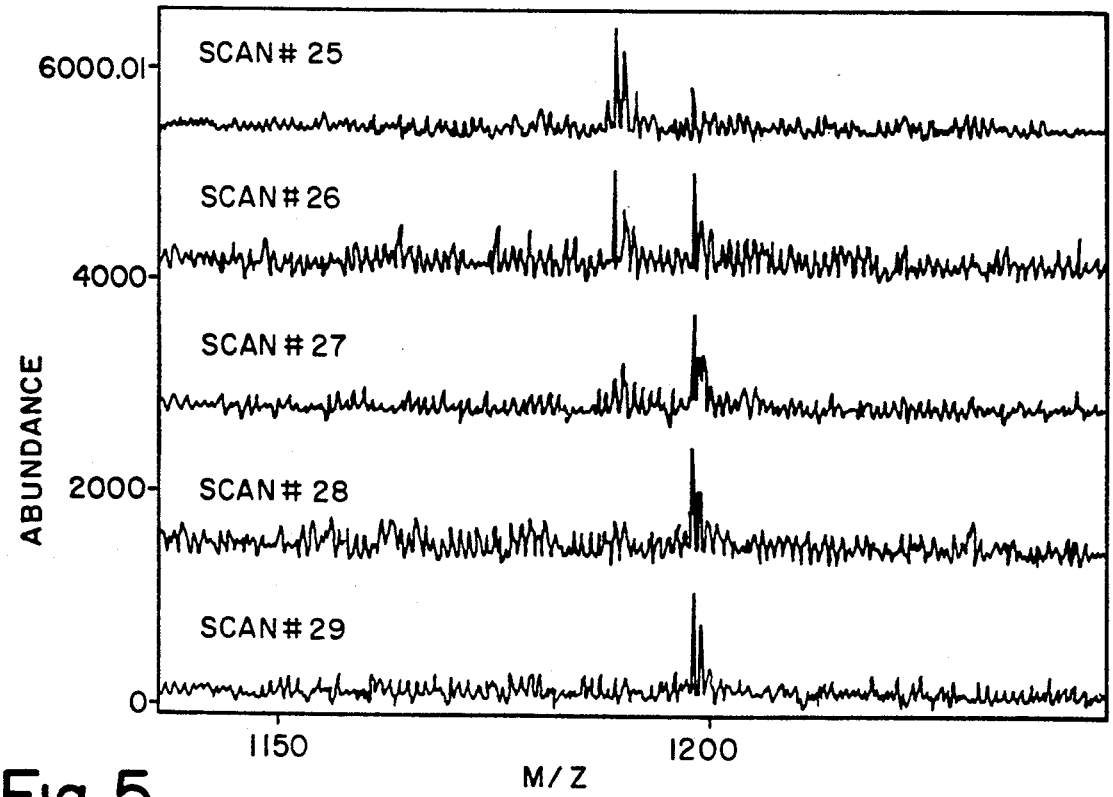

Referring to FIG. 4, the effect of the time $t_2$ is illustrated. The mass spectra for scans numbered 2, 10, 16 and 25 were taken with the same sample at 20 second intervals. Scan 2 is generated from the fresh sample. Note that the abundance of the peaks corresponding to the peptide near m/z 1190 does not diminish from pulse to pulse. Thus, FIG. 4 illustrates that several measurements of the analyte can be recorded, provided that the time $t_2$ is sufficiently long. For comparison, the mass spectra for scans numbered 25 to 29 shown in FIG. 5 were gathered at 100 millisecond intervals. Note that the abundances at peaks corresponding to the peptide near m/z 1190 are lost after four successive readout periods. The peptide was present in femtomole quantities in a matrix of glycerol. The signal at m/z 1197 increases in successive spectra. This signal is due to the glycerol matrix cluster ion. Thus, FIG. 5 illustrates the differential appearance of analyte and matrix ions following the initiation of sample irradiation.

The results presented show that there is a significant improvement in detection limits for Eledoisin when samples are subjected to pulsed bombardment rather than the conventional continuous bombardment. The effect has been observed in a qualitative fashion for numerous other samples and appears generally applicable. It has been noted that when the analyte is more mobile in the matrix, for example, Eledoisin in 3-nitrobenzyl alcohol, the advantages of this invention may not be observed. The matrix should be selected to have a surface tension sufficient to cause a concentration of the analyte at the surface of the matrix. The solvent support system should be chosen such that the analyte/-solvent support system has a surface tension less than that of the solvent. For a peptide such as Eledoisin, the surface tension should be equal to about that of glycerol (64 dynes/cm), say, in excess of 40 dynes/cm.

According to a preferred embodiment, a plurality of readings are taken at each intensity level of the magnetic field for each channel of the array detector while the reset time as determined by delay td is varied stepwise, say, in 10 millisecond steps over a period of, say, 1000–2000 milliseconds starting shortly after the primary beam is turned on, say, within 20 milliseconds. The data for each channel and delay step is stored in a computer memory, say, in a two-dimensional array. The data for each channel is processed as by comparison or differentiation to distinguish the peaks indicative of analyte from peaks indicative of the matrix. The data may, for example, be inspected to determine the best delay time td for maximizing the signal-to-noise ratio.

Having thus defined the invention in the detail and particularity required by the Patent Laws, what is claimed to be protected by Letters Patent is set forth in the following claims.

We claim:

1. A method of mass spectrometry for analyzing a sample mixed with a matrix, comprising the steps of:

a) ionizing the mixture of the sample and the matrix by repeated irradiation with primary particle beam pulses;

b) introducing the produced ions into a mass analyzer and separating the ions with the mass analyzer according to their mass/charge ratios;

c) detecting signals indicative of the number of the separated ions with an array detector; and d) integrating the detected signals during data collection periods in synchrony with the irradiation pulses of the primary particle beam, said data collection periods having a predetermined duration and predetermined start times relative to the primary particle beam pulses.

2. The method according to claim 1 in which the sample contains large molecules of organic origin that tend to decompose on heating.

3. The method according to claim 1 wherein the matrix is selected to have a sufficiently high surface tension such that the rate of ion production in response to the primary particle beam pulses is different for the sample and the matrix.

4. The method according to claim 1 wherein the primary particle beam is comprised of ionized species.

5. The method according to claim 1 wherein the primary particle beam is comprised of neutral species.

6. The method according to claim 1 wherein the mass analyzer comprises electric and magnetic fields for dispersing and projecting the ions.

7. The method according to claim 6 wherein the mass analyzer comprises a double-focusing mass spectrometer.

8. The method according to claim 1 wherein the array detector is reset up to 50 milliseconds following the start of the particle beam pulse.

9. The method according to claim 8 wherein the array detector is read up to one second following reset of the array detector.

10. The method according to claim 1 wherein the particle beam pulses are spaced between 0.25 and 20 seconds apart.

11. The method according to claim 1 wherein the reset and readout times of the array detector are adjusted until the ratio of a signal indicative of one large molecule in the sample to the background signal is maximized for a given set of spectrometer conditions.

12. The method according to claim 11 wherein after the signal ratio is maximized and the array detector is read one or more times, the magnetic field of the mass spectrometer is jumped stepwise, and the reading and jumping steps are repeated until the desired mass range is detected.

13. The method according to claim 1 further comprising the steps of:

e) stepwise advancing the start time relative to the primary particle beams pulses, f) repeating steps a) to e) a plurality of times to collect a two-dimensional array of data for each channel and each start time, and g) processing the two-dimensional array of data to distinguish analyte data from matrix data.

14. The method according to claim 1 further comprising the steps of:

e) stepwise advancing the start time relative to the primary particle beam pulses, f) repeating steps a) to e) a plurality of times to collect a two-dimensional array of data for each channel and each start time, and g) analyzing the two-dimensional array of data to determine the optimum start time for distinguishing analyte data and matrix data.

15. In a mass spectrometry system for analyzing a sample mixed with a matrix, comprising a means for supporting the sample and matrix, a particle beam generator, a mass analyzer and a detector, the improvement comprising:

a) means for generating a particle beam pulse for ionizing the mixture of the sample and the matrix by repeated irradiation to produce analyte and analyte fragment ions;

b) means for introducing the produced ions into the mass analyzer for separating the ions according to their mass/charge ratios;

c) dètecting means at the output of the mass analyzer for detecting signals indicative of the number of separated ions incident thereto, which detecting means can be reset by a reset signal and read by a readout signal to define a data collection period; and d) timing means for controlling the frequency of the particle beam pulse, and the times of the reset signals and readout signals relative to the start of the particle beam pulse.

16. The improvement according to claim 15 further comprising means in synchronism with the irradiation of the primary particle beam pulse for integrating the detected signals gathered during more than one data collection period.

17. The improvement according to claim 15 wherein the means for generating a primary particle beam generates ionized species.

18. The improvement according to claim 15 wherein the means for generating a primary particle beam generates neutral species.

19. The improvement according to claim 15 wherein the mass analyzer comprises electric and magnetic fields for dispersing and separating the ions.

20. The improvement according to claim 19 wherein the mass analyzer comprises a double-focusing mass spectrometer.

21. The improvement according to claim 15 wherein the timing means causes the array detector to be reset up to 50 milliseconds following the start of the primary particle beam pulse.

22. The improvement according to claim 21 wherein the timing means causes the array detector to be read up to 500 milliseconds following reset thereof.

23. The improvement according to claim 15 wherein the timing means causes the primary particle beam pulses to be spaced between 0.25 and 20 seconds apart.

24. The improvement according to claim 15 wherein the timing means causes the array detector to be read at one or more times at a given magnetic field strength and then causes the magnetic field strength to be jumped stepwise.

* * * * *

UNITED STATES PATENT AND TRADEMARK OFFICE

CERTIFICATE OF CORRECTION

PATENT NO. : 5,077,470

DATED : December 31, 1991

INVENTOR(S) : Robert B. Cody and Andrew N. Tyler

It is certified that error appears in the above-identified patent and that said Letters Patent is hereby corrected as shown below:

On the Title page, item [56], Other Publications insert the following:

--"Differential Appearance of Analyte and Matrix During the First Seconds of Sputtering by Fast Atom Bombardment", Musselman et al., presented at the 35th ASMS Conference on Mass Spectrometry and Allied Topics (Denver, CO, May 1987) pp. 302-303.

"Tandem Quadrupole-Fourier Transform Mass Spectrometry: New Developments", Shabanowitz et al., presented at the 34th Annual Conference on Mass Spectrometry and Allied Topics (Cincinnati, OH, June 1986) pp. 945-946.

"Desorption Mechanisms Using a New Liquid-SIM-TOF Mass Spectrometer", Olthoff et al., presented at the 35th ASMS Conference on Mass Spectrometry and Allied Topics (Denver, CO, May 1987) pp. 735-736.--

Column 3 Line 20 "lo" should read --10--.

Signed and Sealed this

Eighth Day of June, 1993

*Attest:*

Michael K. Kirk

MICHAEL K. KIRK

*Attesting Officer*

*Acting Commissioner of Patents and Trademarks*